US005357896A

United States Patent [19]

Roerig

[11] Patent Number: 5,357,896

[45] Date of Patent: Oct. 25, 1994

[54] JIFFY LAUNCH BOAT HOOK

[76] Inventor: Louis Roerig, 6250 6th St. N.E., Fridley, Minn. 55432

[21] Appl. No.: 151,143

[22] Filed: Nov. 12, 1993

[51] Int. Cl.[5] ..... B63B 21/64

[52] U.S. Cl. ..... 114/344

[58] Field of Search ..... 114/344, 230, 249, 251, 114/253; 294/82.1; 24/265 H

[56] References Cited

U.S. PATENT DOCUMENTS

| | | | |
|---|---|---|---|
| 651,091 | 6/1900 | Williams | 294/82.1 |
| 769,333 | 9/1904 | Aubrey | 294/82.1 |
| 3,797,681 | 3/1974 | Bettrager | 280/414.1 |

*Primary Examiner*—Jesus D. Sotelo

[57] ABSTRACT

A boat 30 launching hook 10 device comprising a formed end opening 18 and a second formed opening 23 and a closed formed opening 22 in correct positions, allows a safe and easier launch into the water (not shown), from a trailer 32 with rollers.

1 Claim, 2 Drawing Sheets

JIFFY LAUNCH BOAT HOOK

BACKGROUND-FIELD OF INVENTION

The invention relates generally to an improved procedure for launching a boat into the water, from a boat trailer with rollers.

BACKGROUND-DESCRIPTION OF PRIOR ART

Launching a boat has always carried some level of frustration and difficulty. Many different factors contribute to the difficulties of launching a boat. Due to the public buying larger and heavier boats for recreational purposes, Trailers with rollers were created. The rollers allow the boat to move easily on and off the trailer. The rollers can create premature launches, if the boat is not secured with a safety chain tether and/or winch rope. Safety chain tethers with a hook are standard equipment with a trailer with rollers.

If the launch site is too steep when the boat trailer is backed down the launch site, the weight of the boat will cause the boat to roll backwards off the trailer prematurely. The heavier the boat, the faster and more easily the boat will roll backwards off the trailer. This will create a hazard to the boater.

When the water level is too low, the trailer has to be backed further down the launch site in the water. This creates a backward or downward pressure on the winch rope. The boat will then have to be manually retained in order to remove the winch rope from the eye bolt on the boat. This can be extremely difficult and very dangerous for one person to do.

When the water level is normal or too high, the problems still exist. The boat will still tend to roll off the trailer. Under ideal conditions, a boat launch can be difficult. If only one person is involved in the launch, it is extremely difficult.

If the winch rope hook and the safety chain tether are disconnected from the boat before the boat and trailer are at the launch site, and the boater starts to back down the launch site with the trailer, the boat can unload prematurely, before the launch site is reached. For this reason, boaters remove the winch rope and the safety chain hook, when the trailer and boat are at the water's edge.

Some boaters secure a rope tether to a cleat on the boat. This rope is then wrapped around the winch post several times. This tether rope is used to prevent the boat from unloading, until the winch rope hook is removed from the eye bolt on the boat. Now the tether rope has to be rapidly unwound from the winch post, to allow the boat to unload from the trailer, into the water. This procedure could create an unsafe condition in which the boater could lose control of the boat.

OBJECTS AND ADVANTAGES

Accordingly, the primary objects and advantages of my invention is to eliminate the frustration and difficulty of launching a boat. My invention gives complete control of the launch to the boater. It will simplify a single-person launch, especially on a steeply inclined ramp.

The launch will require only a tether rope to keep the boat from floating away after the boat is launched. Thus, there will be no extra ropes to become entangled with the operator, boat or trailer.

The safety chain tether will now serve two purposes with my invention. Using my invention, the safety chain tether will secure the boat to the trailer in transit. Also, by using my invention with the safety chain tether, it will add to the safety of the launch.

The boater will have complete control of the launch when using my invention. I have tested the invention repeatedly, under all conditions. I have not had any failures or problems launching a boat with my invention. It is fast, safe and easy to use. Any person who can operate a boat legally, could launch a boat with my invention. Further objects and advantages of my invention will become apparent from a consideration of the drawings and ensuing description.

SUMMARY OF THE INVENTION

The invention relates to an improved procedure for launching a boat one's self into the water. It is an object of the invention to provide a safer and easier means of launching a boat from a trailer with rollers.

Although detailed embodiment of the invention is illustrated in the drawings and previously described in detailed, this invention contemplates any configuration, design and relationship of components, which will function in a similar manner, and which will provide the equivalent result.

FIG, 3 is a fragmentary perspective view of a boat and the hook device with a safety chain tether, prior to launch.

Figure 4:
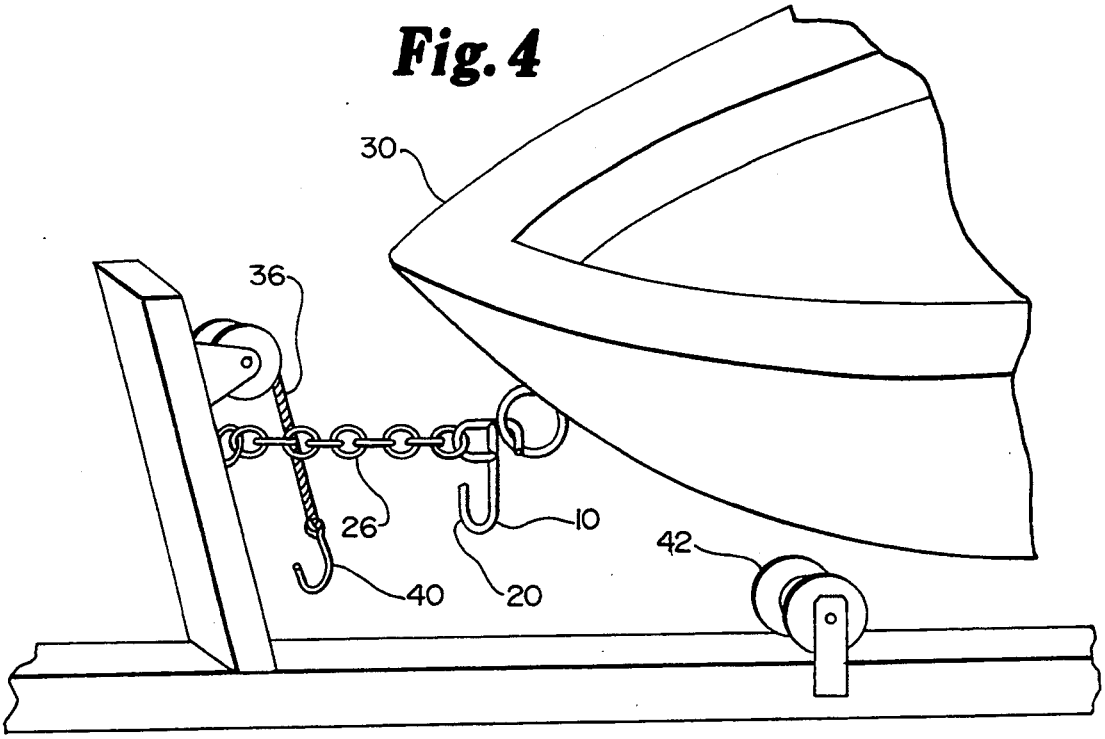

FIG. 4 shows a fragmentary perspective view of a boat and the hook device, in the launching position.

LIST OF REFERENCE NUMERALS

| | | | |
|---|---|---|---|
| 10 | hook device | 26 | safety chain tether |
| 12 | welded area | 28 | eye bolt |
| 14 | welded area | 30 | boat |
| 16 | shank base | 32 | boat trailer |
| 18 | formed opening | 34 | hull of boat |
| 20 | extension | 36 | winch rope |
| 22 | formed closed opening | 38 | winch post |
| 23 | bend | 40 | winch rope hook |
| 24 | overbend extension | 42 | rollers |

DESCRIPTION OF THE PREFERRED EMBODIMENT

Referring to FIGS. 1, 2, 3 and 4, an embodiment of the JIFFY LAUNCH BOAT HOOK is shown.

In this embodiment, the drawings show a hook device indicated generally at 10. The hook 10 device is made from two formed pieces of steel rod, welded together at area 12 and 14. Alternatively, the hook 10 device may be made from steel castings. Other materials and methods of manufacture may be suitable and the present hook 10 device is not limited to any particular material or method of manufacture.

Producing the hook 10 device from a steel casting would most likely increase the cost of the hook 10 device. The steel rod is preferred for the safety factor involved in launching a boat.

Figure 1:
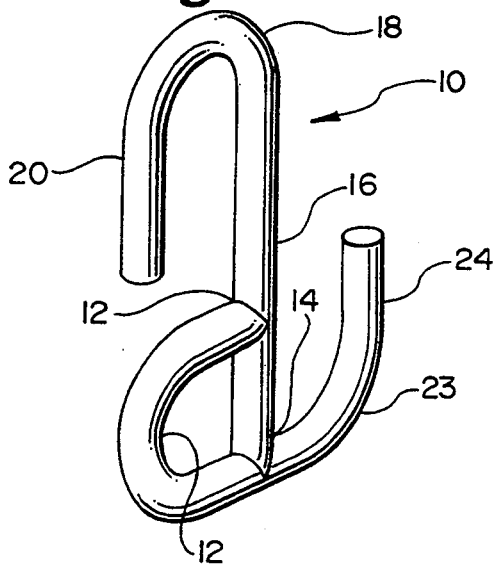
FIG. 1 is a perspective view of the hook device

Referring to FIG. 1, the thusly unitary and integral hook 10 device comprises a shank base 16 with a formed bend 18 of approximately 180 degrees, with an extension 20, parallel with the shank base 16. The piece of rod forming the closed opening 22 shall extend beyond the shank base 16 and form a formed opening 24. The formed opening 24 shall have an overbend 24. The overbend extension 24 shall be between 3 degrees and 20 degrees, preferably 10 degrees for safety and ease of launching a boat 30 with the hook 10 device.

Figure 2:
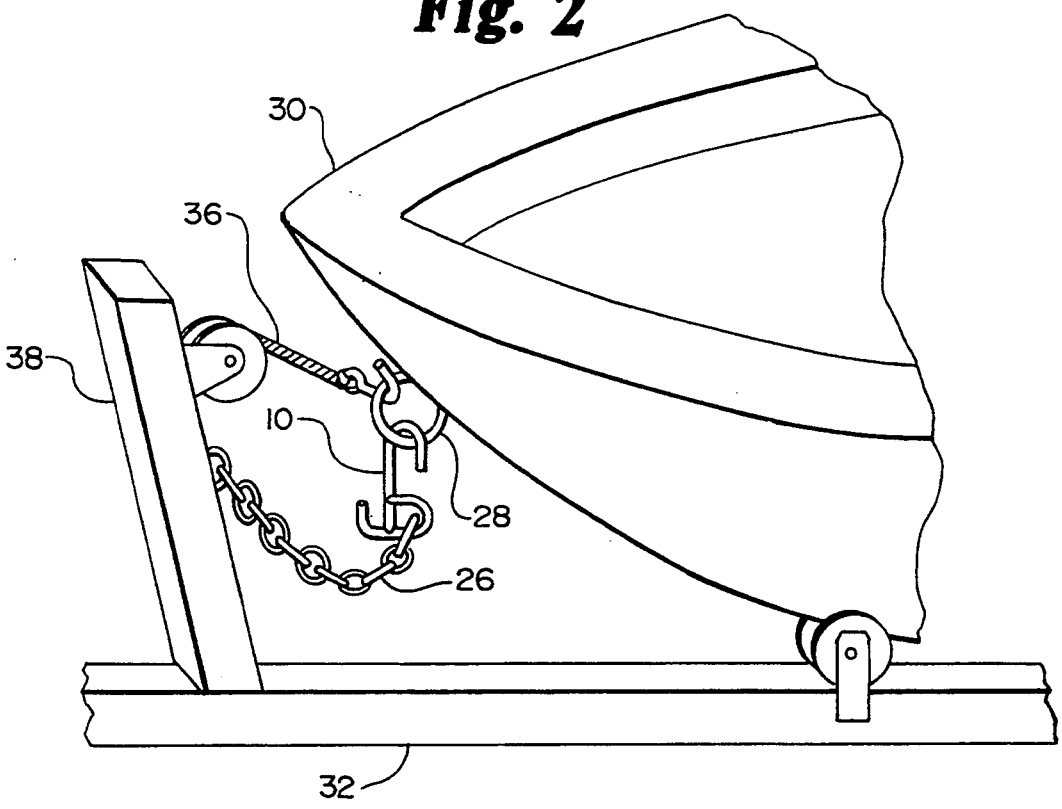
FIG. 2 is a fragmentary perspective view of a boat and the hook device with a safety chain tether, used for boat transit safety.

Referring to FIG. 2, in the embodiment, the formed closed opening 22 shall be of sufficient size to accommodate a safety chain tether 26.

Referring to FIG. 2, the winch rope hook 40 is attached to the eye bolt 28, to secure the boat 30 to the trailer 32. The hook 10 device as claimed, is attached to a safety chain tether 26 at the formed closed opening 22. The hook 10 device is attached to the eye bolt 28 at the formed opening 18, and is used for safety of a boat 30 and trailer 32 in transit, on a public or private road (not shown).

Referring to FIG. 2, for use of the hook 10 device, for transit, attach the hook 10 device to one end of the safety chain tether 26 at formed closed opening 22 of the hook 10 device. The other end of the safety chain tether 26 is secured to the winch post 38 on the boat trailer 32. Insert the hook 10 device at formed opening 18 to the eye bolt 28 on the hull of the boat 30. The larger formed opening 18 of the hook 10 device is used for safety transit of a boat, on a public or private road.

Figure 3:
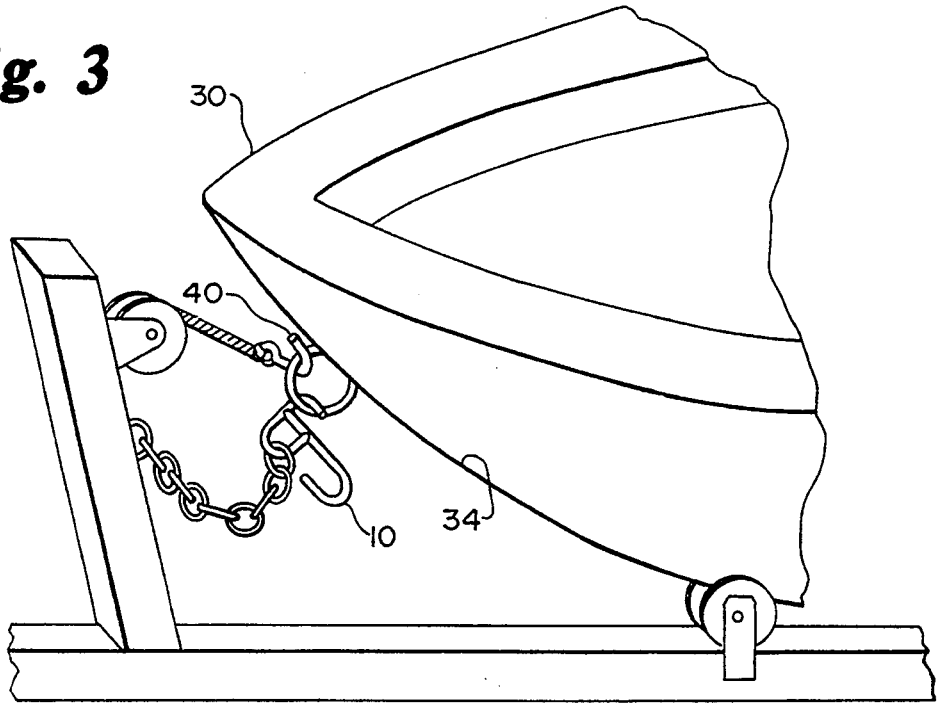

Referring to FIG. 3, the formed opening 24 with an overbend as claimed, is attached to the eye bolt 28, prior to launching a boat 30 into the water (not shown).

Referring to FIG. 4, the winch rope 36 and hook 40 are disconnected from the eye bolt 28. FIG. 4 shows the safety chain tether 26 taut. The hook 10 device as shown is attached to the eye bolt 28 at the formed opening 24. The hook 10 device is shown at the correct position for launching a boat 30 into the water (not shown).

OPERATION OF FIGS. 1, 2 AND 3

The procedure for launching a boat 30 into water (not shown) with the hook 10 device is as follows:

A. Position boat near the launch site on level ground.

B. Remove hook 10 device from the eye bolt 28.

C. Attach the hook 10 device at formed opening 24 to the eye bolt 28. The weight of the safety chain tether 26 combine with the weight of the hook 10 device will cause the hook 10 device to hang with the formed bend 18 downward. The hook 10 device is now hanging in the eye bolt 28 in the formed bend 23 of the formed opening 24.

D. Unwind the winch rope 36 until the safety chain tether 26 becomes taut. The winch rope 36 will now become slack. Remove the winch rope hook 40 from the eye bolt 28. As the safety chain tether 26 becomes taut and as the winch rope 36 is unwound, the hook 10 device is pulled from the bend 23 until it arrives at the overbend extension 24. The overbend extension 24 prevents the hook 10 device from coming off the eye bolt 28 completely and causing a premature launch.

E. Bump the hook 10 device with the heel of the hand (not shown) towards the boat 30, at the extension 20. Bumping the hook 10 device at the extension 20 causes movement of the hook 10 device. The movement causes the hook 10 device to rotate from the formed opening 24, releasing and launching the boat 30 into the water (not shown).

I claim:

1. Apparatus for facilitating the launching of a boat from a boat trailer wherein the boat includes an eyebolt on the bow to receive a hook secured to a winch line, said apparatus comprising: tether means secured at one end to a forward portion of the trailer and provided with hook means at its other end; said tether means being of a length to provide a slight slack thereon when the hook means is engaged in the eyebolt of a boat fully loaded on the trailer; said hook means comprising a generally U-shaped member having one short leg and one long leg end defining a closed loop on one side thereof and an open hook on the other side; wherein the hook means is secured to the tether means by means of the closed loop, and the short leg and the open hook define hook elements to selectively engage the eyebolt during transit and during launching, respectively.

* * * * *